United States Patent [19]

Ethridge et al.

[11] 3,977,059

[45] Aug. 31, 1976

[54] TEXTILE FLUID CRIMPING PROCESS AND APPARATUS

[75] Inventors: Fredrick Allen Ethridge; Michael Paul Taylor; Scott Winfield Thompson, all of Charlotte, N.C.

[73] Assignee: Fiber Industries, Inc., Charlotte, N.C.

[22] Filed: Sept. 13, 1974

[21] Appl. No.: 505,717

Related U.S. Application Data

[62] Division of Ser. No. 250,204, May 4, 1972, Pat. No. 3,852,857.

[52] U.S. Cl. ..... 28/72.11; 28/72.12; 28/72.14

[51] Int. Cl.[2] ..... D02G 1/20

[58] Field of Search ..... 28/1.4, 1.6, 72.14, 28/72.12, 72.11

[56] References Cited

UNITED STATES PATENTS

| | | | |
|---|---|---|---|
| 3,669,328 | 6/1972 | Castelli | 28/1.6 X |
| 3,727,275 | 4/1973 | Ohayon | 28/1.4 |
| 3,729,831 | 5/1973 | Kosaka et al. | 28/1.4 |
| 3,778,872 | 12/1973 | Newton | 28/1.6 |

*Primary Examiner*—Louis K. Rimrodt
*Attorney, Agent, or Firm*—Robert J. Blanke

[57] ABSTRACT

Process and apparatus for crimping filamentary material, the process comprising forcing hot fluid entrained yarn into a crimping chamber in one direction, forcing cold fluid into the crimping chamber from an opposite direction and exhausting both fluids from the crimping chamber either radially and/or axially. The apparatus employs a crimping chamber having axially aligned entrance and exit portions and means within the crimping chamber for radially exhausting fluids.

14 Claims, 3 Drawing Figures

TEXTILE FLUID CRIMPING PROCESS AND APPARATUS

This is a division of application Ser. No. 250,204, filed May 4, 1972 now U.S. Pat. No. 3,852,857, issued Dec. 10, 1974.

This invention relates to the fluid compression of fibrous masses and more particularly to controlled pneumatic stuffer box compression of fibrous masses.

Compressed strand treatment processes wherein the strand is passed through a phase as a compressed fibrous mass for purposes of obtaining a crimped, bulked yarn are wellknown as exemplified by mechanical stuffer box crimping, representative of which is the mechanical stuffer box crimping disclosed in U.S. Pat. No. 3,605,221. In such a system, filaments are forced by means of a pair of nip rolls into a confined area, the confined area or stuffer chamber being formed by doctor blades which make up opposing side walls and stationary back plates. Compression of the fibrous mass which results in crimp, is produced by the nip rolls forcing the filamentary material into the stuffer chamber. On reaching a pre-determined pressure, the doctor blades diverge and release filamentary material. Mechanical stuffer box crimping while producing a satisfactory end product, lacks processing speed and moreover, the crimped, bulked yarn exhibits certain nonuniformities due to the withdrawal of the yarn over the high friction mechanical restraints present at the exit portion of mechanical stuffer box crimping.

Attempts have been made to overcome the limitations of mechanical stuffer box crimpers by the application of fluid feed or restraint of the yarn plugged in the stuffer box crimping chamber. Exemplary of fluid feed stuffer box crimping are U.S. Pat. No. 3,343,240 and East German Pat. No. 17786. In pneumatic feed stuffer box crimping, filamentary material is fed by means of a fluid under pressure which is preferably hot, into a passageway which subsequently flares into a crimping chamber which may have gas permeable walls to allow radial escape of the texturing fluid while retaining the yarn causing a reduction in yarn running speeds, thereby producing a yarn accumulation or a plug. Yarn, when extracted from this plug, is found to have a desirable degree of crimp; however, a primary difficulty is induced by the need to employ a heated fluid as a filament transfer medium in order to compensate for the lower compaction forces, and to produce sufficient crimp. As a result, the compressed mass must be subjected to special handling on withdrawal from the compression zone to prevent removal of crimp from the still plastic yarn.

Exemplary of efforts to retain the high compression nip roll feed of standard mechanical stuffer box apparatus while employing a fluid pressure to obtain a plug or strand accumulation is U.S. Pat. No. 3,435,497. However, the forces which a nip roll feed exert on a yarn plug are so great so as to prevent a fluid back pressure from successfully exerting a compressive force. Therefore, in order to obtain satisfactory crimping pressures, it is still necessary to employ a high friction mechanical restraint in addition to the pneumatic back pressures, and hence, the same deficiencies which are present in a standard mechanical stuffer box crimping device are still present. As can be seen from the aforementioned pneumatic, mechanical and combination stuffer box crimping apparatus, the continuous transfer of the extended running strand to the head of the compressed mass is easily done. However, the retention of the terminus of the mass with uniform compression while simultaneously extracting and re-extending the strand gives rise to many difficulties, common among which is the frictional restraint on the yarn plug. Frictional restraint produces a "stick-slip" motion of the yarn; that is to say, the yarn is either moving freely, resulting in uncrimped areas, or being subjected to compressive forces which result in highly crimped areas. The overall result of frictional restraint is a lack of crimp uniformity in the yarn.

It is therefore an object of this invention to provide a process for pneumatic stuffer box crimping of yarn by uniformly compressing the yarn mass while simultaneously and uniformly extracting and re-extending the strand.

It is an additional object of this invention to provide an apparatus for pneumatic stuffer box crimping of yarn wherein the means for uniformly compressing the yarn mass simultaneously cools the yarn mass.

These and other objects of the invention will be more readily apparent from the following detailed discussion.

In accordance with the present invention, it has now been discovered that a fully pneumatic stuffer box crimping process may be employed for the high speed production of uniformly bulked yarn having desirable crimp form. The apparatus employed comprises a hot, fluid yarn forwarding jet secured to a crimping chamber having fluid openings, such as perforations, therein. Yarn which has been entrained by the hot fluid carried through the yarn processing bore of the yarn forwarding jet into the crimping chamber is caused to undergo a reduction in velocity due to the change in the vector forces of the hot fluid, thereby forming a yarn plug. The exit portion of the crimping chamber is secured to a cold fluid yarn braking jet which causes a cooling fluid to flow into the crimping chamber through the yarn plug. The cooling fluid has the ability to set the yarn in its crimped configuration and provide adequate back pressure to provide crimp producing plug compression. The back pressure provided by the cold fluid, however, is not a frictional restraint such as will result in a "stick-slip" motion of the yarn with resultant crimp nonuniformity. The hot fluid and the cooling fluid may be either radially and/or axially exhausted.

The yarn forwarding jet preferably has an elongated bore downstream of the fluid entry ports which are symmetrically arranged at a forwarding angle to the longitudinal axis of the bore. The purpose of the elongated bore is to effect a heat transfer between the fluid and the yarn and apparently initiates a minor crimp in the yarn by subjecting the yarn to fluid turbulence. The bore diameter of the yarn forwarding jet is preferably smaller than the bore diameter of the yarn braking jet in order to cause such axial exhaust as does occur to flow primarily out of the yarn bore of the yarn braking jet. It is also preferred that the crimping chamber be enclosed in a shroud having a downwardly directed duct for purposes of preventing the release of fluid entrained yarn finishes into the atmosphere.

The hot fluid suitable for use in conjunction with this invention may be hot air, steam, or hot inert gases such as nitrogen. Correspondingly, the cold fluid media for purposes of this invention may be cold gases such as cold air, or cold nitrogen. Filamentary materials suitable for processing in accordance with this invention are any thermoplastic filamentary materials such as polyamides, polyesters, cellulose ethers and esters, polyolefins, acrylic and vinyl polymers.

A better understanding of the invention may be had from the drawings wherein.

Figure 1:
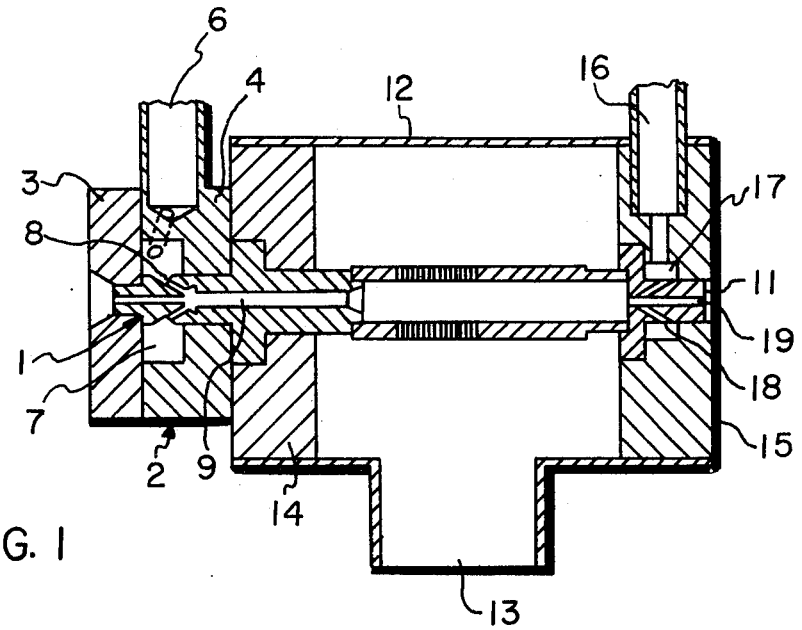
FIG. 1 is a cross-sectional view of the pneumatic stuffer box apparatus of this invention.
Figure 2:
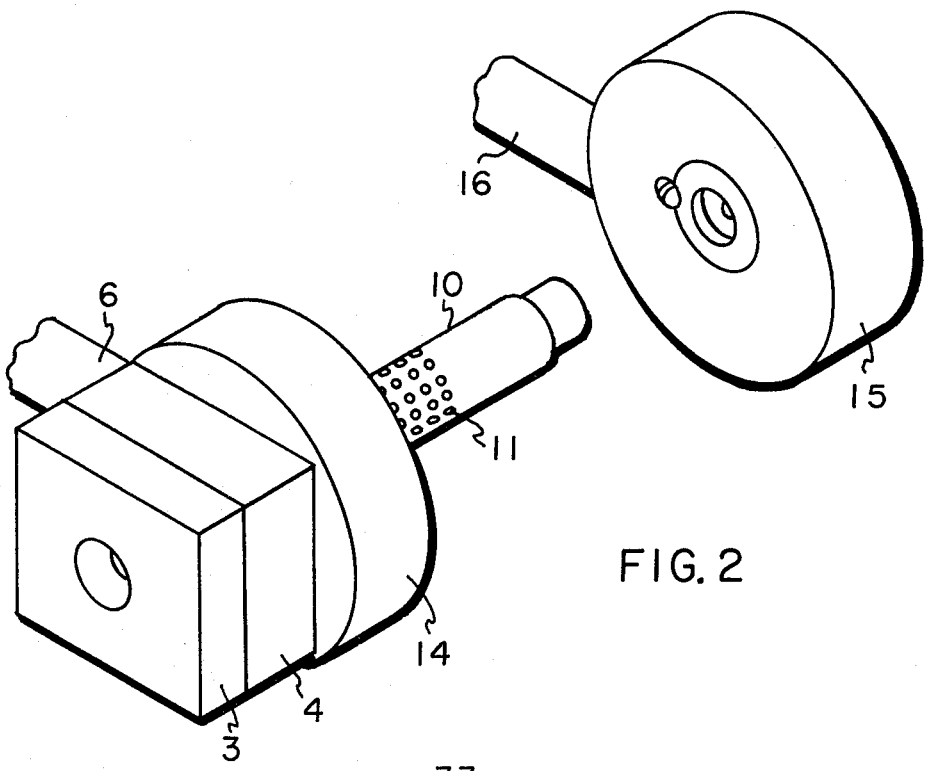
FIG. 2 is an exploded view, less shroud member, of the pneumatic stuffer box crimping apparatus of this invention.

Turning to FIG. 1, a yarn forwarding jet is housed within a heated, fluid plenum chamber housing 2 which for case of construction is composed of cover plate member 3 and body member 4. Body member 4 contains fluid feed line 6 which feeds fluid to plenum chamber 7. Fluid entry ports 8 are symmetrically disposed in yarn forwarding jet 1 at an acute forwarding angle to the longitudinal axis of yarn processing bore 9. Yarn processing bore 9 is flared at its downstream extremity, that portion of yarn processing bore lying between said flared portion and the fluid entry port 8 being elongated and comprising the major portion of the total length of yarn processing bore 9. Yarn forwarding jet 1 is secured to bulking chamber 10, which in turn is secured to yarn braking jet 11. Crimping chamber 10 has perforations 11 radially disposed in the walls so as to exhaust gases issuing from yarn forwarding jet 1 and yarn braking jet 11. The geometry of bulking chamber 10 may be better seen from FIG. 2 of the drawings. A shroud member 12 preferably encloses crimping chamber 10, shroud member 12 having a duct 13 at the bottom thereof for removal of any yarn finishes and the like which may be entrained by exhausting fluids. Shroud member 12 is conveniently secured to retaining members 14 and plenum housing 15. Plenum housing 15 has fluid supply line 16 secured thereto for passage of cold fluid to plenum chamber 17. Yarn braking jet 11 has fluid entry ports 18 symmetrically disposed in yarn braking jet 11 at an acute braking angle to the longitudinal axis of yarn processing bore 19.

Figure 3:
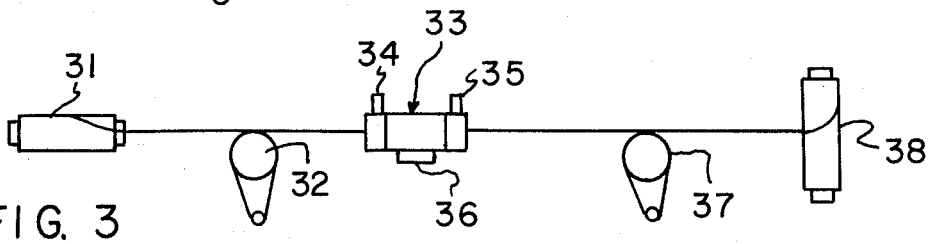
FIG. 3 is a schematic view of an apparatus arrangement using the pneumatic stuffer box of this invention.

A yarn processing sequence in simplified form is set forth in FIG. 3 of the drawings wherein yarn is taken from a drawn yarn supply package and passed over a set of tensioning rolls 32 and then into a pneumatic crimper 33, wherein a heating fluid is fed into feed line 34 and a cooling fluid is fed into feedline 35, both the fluids and the entrained yarn finishes being exhausted through duct member 36. Yarn emerging from fluid crimping device 33 is in a set, crimped configuration and is passed over a second set of tensioning rolls 37 and then onto a take-up bobbin 38.

The processing sequence may be better understood from the following specific examples. While the examples are primarily directed to texturing fully drawn yarns, it should be understood that yarns in any stage subsequent to texturing may be employed, whereby drawing may be accomplished in conjunction with texturing operations in either continuous or discontinuous operations. It should also be understood that the Examples are given for purposes of illustration and should not be construed as limiting the spirit or scope of this invention.

EXAMPLE I

A nylon 66 yarn having a T-cross section and a denier of 8620 and 136 filaments is drawn over a pin heated to 110°C at a speed of 2090 feet per minute so as to produce a 2145 denier, 136 filament yarn. The drawn yarn is taken up on a supply package as illustrated in FIG. 3 of the drawings and then fed into the pneumatic crimping device of the invention at 33.2% overfeed. The yarn forwarding jet employs yarn processing bore diameters of 0.030 inch and 0.070 inch, the latter being of course, the downstream diameter. Four equally spaced 0.020 inch diameter fluid entry ports are employed in the yarn forwarding jet. The crimping chamber is 1.125 inches long and has a ¼ inch inside diameter with 96 holes of 0.031 inch diameter disposed therein. The forwarding jet is supplied with steam at 135 pounds per square inch gauge at 375°C while the yarn braking jet is supplied with ambient temperature air at 40 pounds per square inch gauge. The final product is found to have a denier of 2750 and 33.5% crimp.

EXAMPLE II

An 8620 denier/136 filament nylon 66 T-cross section yarn is spun and drawn at 2090 feet per minute to produce a 2145 denier 136 filament yarn which is taken up on the feed package as illustrated in FIG. 3. As further illustrated in FIG. 3, the yarn is fed to the pneumatic stuffer box crimper of this invention and textured at 41.6% overfeed using air at 180 pounds per square inch gauge and 428°C temperature as the hot fluid. Air at ambient temperatures is employed as the cooling fluid at 60 pounds per square inch gauge. The resulting textured yarn is found to have a denier of 2750 and a 40% crimp.

EXAMPLE III

Using the process substantially as illustrated in FIG. 3 of the drawings, a 2176 denier/138 filament nylon 66 yarn is wound on a supply package, the yarn having been spun as 8745 denier/138 filament T-cross section, drawn at 2090 feet per minute. The yarn is fed from the supply package to the pneumatic stuffer box crimper of this invention at a 33% overfeed. Steam at 135 pounds per square inch gauge and 385°C is fed to the forwarding jet. Air at ambient temperatures and 60 pounds per square inch gauge is fed to the braking jet. The end product is a textured yarn having about 35% crimp.

EXAMPLE IV

A polyethylene terephthalate yarn having 8.4 grams per denier tenacity and 13.2% elongation at break was fed into the pneumatic stuffer box crimper of this invention at a rate of 1500 feet per minute and 15.5% overfeed. Hot air at 80 pounds per square inch gauge and 700°F is fed to the forwarding jet. Air at ambient temperatures is fed to the braking jet having a yarn processing bore of 0.081 inch in diameter and four fluid entry ports of 0.031 inches in diameter. A 943 denier yarn with 28% crimp and 7.2 gramas per denier tenacity and 20.1% elongation at break is obtained.

EXAMPLE V

A 4000 denier/68 filament T-cross section, nylon 6 yarn is spun and drawn at 2060 feet per minute using a cold draw roll. The drawn yarn is then fed into the stuffer box crimper of this invention at 42% overfeed. Hot air at 150 pounds per square inch gauge and 1000°F is supplied to the forwarding jet. A braking jet is supplied with air at ambient temperatures and 60 pounds per square inch gauge pressure. A textured yarn of 1350 denier and 37.5% crimp is obtained.

EXAMPLE VI

A 51 relative viscosity polycaprolactam polymer is spun as "T" cross-section 7800 denier 136 filament yarn. The yarn is then drawn at 2,062 feet per minute over a heated draw roll heated to 130°C and continuously textured in the apparatus of this invention employing steam in the forwarding jet at 90 pounds per square inch gauge and 385°C and air at ambient temperature and 60 pounds per square inch gauge in the braking jet. A 34.5% overfeed is employed and a textured yarn of 2525 denier and 35% crimp is obtained.

EXAMPLE VII

A 1000 denier 68 filament drawn polyester yarn prepared from the ester of terephthalic acid and 1,3 butanediol is textured in the apparatus of this invention. Air at 750°F and 80 pounds per square inch gauge is supplied to the forwarding jet while air at ambient temperatures and pressures of about 40 pounds per square inch gauge is supplied to the braking jet. Employing a 14.3% overfeed, a textured yarn of 1300 denier and 40% crimp is obtained.

The phrase "percent crimp" as employed herein defines a measurement of the relaxed steamed length compared with extended steam length of textured yarns which have been steamed to develop recoverable latent crimp. The testing procedure involves 110cm. sample lengths of yarn which are formed into bundles and placed into a steam bath for a period of about 5 minutes. The samples are then dried and conditioned at about 70°F and about 65 relative humidity for about five minutes. The samples are then weighted with a $7.25 \times 10^{-5}$ gms., per denier weight for about one minute and the length measured, the measurement being defined as $L_1$. The $7.25 \times 10^{-5}$ grams per denier weight is then removed and a weight of 0.15 grams per denier is placed on the end of the sample for about 15 seconds and the sample length again measured and recorded as $L_2$. Percent crimp is then calculated as $L_2 - L_1 / L_2 \times 100$.

Having thus disclosed the invention, WHAT WE CLAIMED IS:

1. A process for fluid crimping yarn, said process comprising forcing hot fluid entrained yarn into a crimping chamber in one direction, forcing a cold fluid into said crimping chamber from an opposite direction and exhausting said fluids from said crimping chamber either radially and/or axially.

2. The process of claim 1 wherein said fluids are substantially radially exhausted.

3. The process of claim 1 wherein said fluids are substantially axially exhausted.

4. The process of claim 1 wherein said yarn is preheated prior to being subjected to said hot fluid.

5. The process of claim 1 wherein said hot fluid pressure is greater than said cold fluid pressure.

6. The process of claim 1 wherein said hot fluid is air.

7. The process of claim 1 wherein said hot fluid is steam.

8. The process of claim 1 wherein said cold fluid is air at ambient temperatures.

9. The process of claim 1 wherein said filamentary material is selected from the group consisting of polyamide, polyester, cellulose ether, cellulose ester, polyolefin, acrylic and vinyl polymer filamentary material.

10. A method of crimping filamentary materials, comprising the steps of providing an enclosed space having axially spaced inlets and outlets and radial venting ports intermediate the same; entraining and inserting into said inlet with a stream of hot fluid having a temperature in the range of from 700°F to 1000°F filamentary material to be crimped, so that such material advances towards said outlet and becomes crimped within said space whereas said hot fluid vents radially through said venting ports; and admitting into said space in the region of said outlet a stream of cool fluid for contact with and initial counterflow to the direction of advancement of the crimped filamentary material, and for subsequent radial venting through said venting ports, whereby to uniformly cool the crimped filamentary material in said space prior to withdrawal of the crimped filamentary material from said space.

11. A method as defined in claim 10; and comprising the step of advancing said crimped filamentary material through said stream of cool gas to said outlet.

12. A method as defined in claim 10; and comprising the step of withdrawing the crimped filamentary material from said space through said outlet.

13. A method as defined in claim 10; further comprising the step of heating said filamentary material prior to entraining thereof.

14. A method as defined in claim 10; wherein said fluids are gaseous fluids.

* * * * *